United States Patent [19]

Almeter et al.

[11] Patent Number: 4,652,754

[45] Date of Patent: Mar. 24, 1987

[54] CORONA GENERATING APPARATUS

[75] Inventors: David D. Almeter; Jon K. Edwards, both of Rochester, N.Y.

[73] Assignee: Eastman Kodak Company, Rochester, N.Y.

[21] Appl. No.: 812,710

[22] Filed: Dec. 23, 1985

[51] Int. Cl.[4] ..... H01T 19/00; G03G 15/02

[52] U.S. Cl. ..... 250/325; 250/326; 353/3 CH; 361/229

[58] Field of Search ..... 250/324, 325, 326; 355/3 CH; 361/229; 313/352, 343

[56] References Cited

U.S. PATENT DOCUMENTS

| | | | |
|---|---|---|---|
| 2,778,946 | 1/1957 | Mayo | 250/49.5 |
| 3,656,021 | 4/1972 | Furuichi et al. | 317/4 |
| 3,723,793 | 3/1973 | Komp et al. | 313/355 |
| 3,727,113 | 4/1973 | Weber | 317/148.5 B |
| 3,943,418 | 3/1976 | Quang | 317/262 A |
| 4,214,733 | 7/1980 | Brückl et al. | 339/274 |
| 4,233,511 | 11/1980 | Harada et al. | 250/325 |
| 4,408,865 | 10/1983 | Camis et al. | 355/3 CH |
| 4,448,511 | 5/1984 | Masuda | 355/3 CH |
| 4,549,244 | 10/1985 | Driessen | 361/229 |

FOREIGN PATENT DOCUMENTS 0144236 6/1985 European Pat. Off. .

OTHER PUBLICATIONS

IBM Tech. Disc. Bulletin, vol. 27, No. 4B, 9/84, "Xerography and Related Processes" pp. 205-206, The Focal Press—Xerox Pub.—Focal Press.

*Primary Examiner*—Bruce C. Anderson
*Assistant Examiner*—Jack I. Berman
*Attorney, Agent, or Firm*—Dennis R. Arndt

[57] ABSTRACT

A corona discharge device having a first corona wire and a second corona wire parallel to the first corona wire and in physical contact therewith, such that the forces created by the wires during energization prevent the vibration of the wires, thereby eliminating short circuiting and the need for costly wire-damping devices.

6 Claims, 14 Drawing Figures

CORONA GENERATING APPARATUS

BACKGROUND OF THE INVENTION

1. Field of the Invention

The present invention relates to an improved corona discharge device for an electrophotographic recording apparatus or the like, and more particularly to a corona generating apparatus that suppresses corona wire vibrations during operation.

2. Discussion of the Art

Corona discharge devices are widely used in various industrial fields such as electrophotographic machines, printing machines, paper manufacturing machines or the like, and are used for charging or in some instances, neutralizing charges. The corona discharge device used for these purposes generally comprises at least one corona discharge electrode in the form of a fine metal wire held taut between connectors or standoffs with a minimum of slack. The gap between the corona wire and the surface of the photoconductive material is generally small for the sake of efficiency. However, as the length of the discharge wire is increased, the tendency to vibrate also increases. In the past, this vibration was believed to have been caused by electrostatic attraction and mechanical vibration. In any event, corona wire vibration results in spark discharge, wire fatigue and nonuniform charging of the photoconductive material. Such spark discharge or short circuiting could result in the breakage of the corona discharge electrode and damage to material being charged.

U.S. Pat. No. 3,656,021 addressed this problem of corona wire vibration by providing means intermediate the corona discharge electrode and a counter electrode for preventing vibration of the corona discharge electrode as a result of electrostatic forces. This is accomplished by having a vibration suppression member positioned between the corona discharge electrode and the counter electrode and substantially parallel thereto, for preventing transverse vibration of said corona discharge electrode as a result of the electrostatic force.

This reference has expressed doubt as to the precise theory and physical mechanism causing the mechanical instability of the corona discharge wires. The explanation as to how and why vibration of the corona wires is suppressed when the insulated vibration suppression members are positioned between the corona discharge electrode and the counter electrode is based on electrostatic forces. The teaching of the patent is more than adequate to allow a person skilled in the art to construct the apparatus as described and realize a significant improvement in corona wire vibration suppression. However, using the theory of operation advanced, it would be difficult for one to extrapolate on the theory of operation in an effort to develop an apparatus.

It has been found that use of insulating materials especially of an organic nature have a tendency to decompose readily in the harsh environment that exists in a corona discharge apparatus and would therefore require routine inspection and replacement.

European Patent Application No. 0 144 236 discloses a corona generating device which comprises a plurality of parallel coronode wires supported between insulating end block assemblies. The coronode wires, made for example, of tungsten oxide are closely spaced e.g., less than 0.2 inches apart such that, when energized, each wire is within the electrostatic fringe field of the adjacent wire. Because the adjacent wires are within the fringe field of each other, one has a tendency to suppress the high output of the other and thereby provide more uniform charge along the length of the corona generating device. The patent states that the spacing of the two wires is absolutely critical in that they must be within the fringe fields generated by each other. The patent advances the proposition that since the two parallel wires provide intersecting fringe fields, a point on one wire opposite a point on the other wire has a tendency to suppress the high output of the other wire. Furthermore, the wires should be parallel to each other to optimize this suppressing effect by each wire on the other wire.

SUMMARY OF THE INVENTION

The invention pertains to an improved charging apparatus wherein vibration of the corona discharge wires during operation is eliminated with the addition of a second wire parallel to and in physical contact with each of the corona discharge wires prior to the application of any bias.

Contrary to earlier beliefs, the electrostatic force has been found to have minimal impact on corona wire vibration. The primary driving force for wire vibration is the repulsive force betweeen the wire and the space charge cloud surrounding it during energization. Thus, oscillation occurs when the appropriate phase relationship exists between the repulsive wire to space charge forces and the restoring mechanical forces acting on the same wire.

An advantage of this dual wire system is that is derives its stability by a displacement of the space charge cloud rather than by locally suppressing its formation. Accordingly, there is no apparent alteration of the corona, and charging is not compromised in any way.

Another advantage is that existing equipment can easily be retrofitted with a second wire placed parallel to, and in continuous physical contact with, the original wire to derive the benefits of this invention. One is also able to use the same corrosion resistant, chemically stable metals that were used for the first corona wire for the second corona wire. Because chemically stable, non-corrosive material may be used, many concerns can be eliminated that have been associated with the use of less stable materials, such as the organic polymers which have been found to deteriorate readily in the harsh corona environment, thereby reducing reliability and increasing maintenance.

BRIEF DESCRIPTION OF THE DRAWINGS

Other objects and advantages of the present invention will be apparent to those skilled in the art from the following description, with reference to the drawings in which like characters denote like parts, wherein.

DESCRIPTION OF THE PREFERRED EMBODIMENT

Because apparatus of the type referred to herein is well known, the present description will be directed, in particular, to elements forming part of or cooperating more directly with the present invention.

Although the corona generating apparatus of the present invention is particularly well adapted for use in an electrophotographic printing machine, it should become evident from the following description that it is equally well suited for use in a wide variety of machines, such as precipitators and is not necessarily limited in its application to the particular embodiment shown herein.

Figure 1:
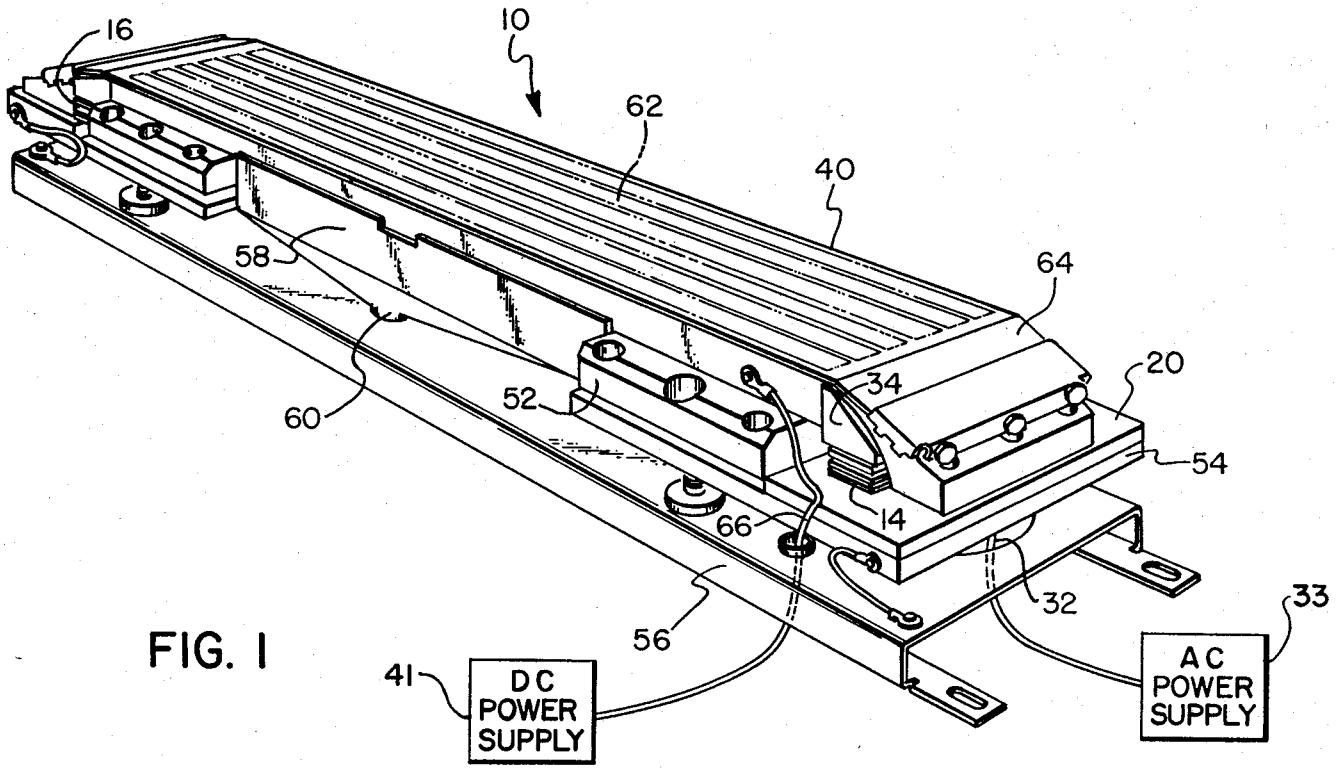
FIG. 1 is a perspective view of a corotron constructed in accordance with the instant invention.

FIG. 1 illustrates a scorotron or corona generating apparatus 10 which is intended to be positioned generally transverse to a photoconductive surface 11, which is mounted on a platen 13. This readily enables the corona generating apparatus 10 to charge the photoconductive surface to a relatively high, substantially uniform potential.

Figure 2:
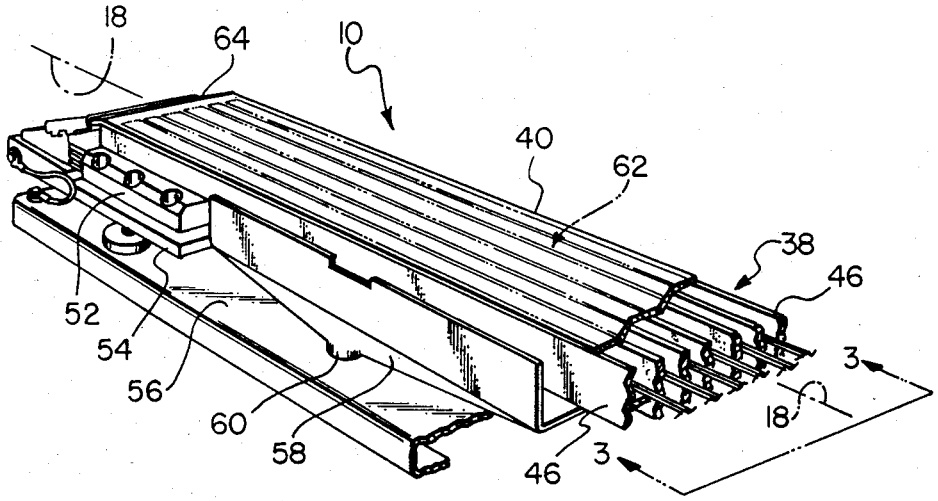
FIG. 2 is a perspective view of the corotron shown in FIG. 1, but partially in section.
Figure 3:
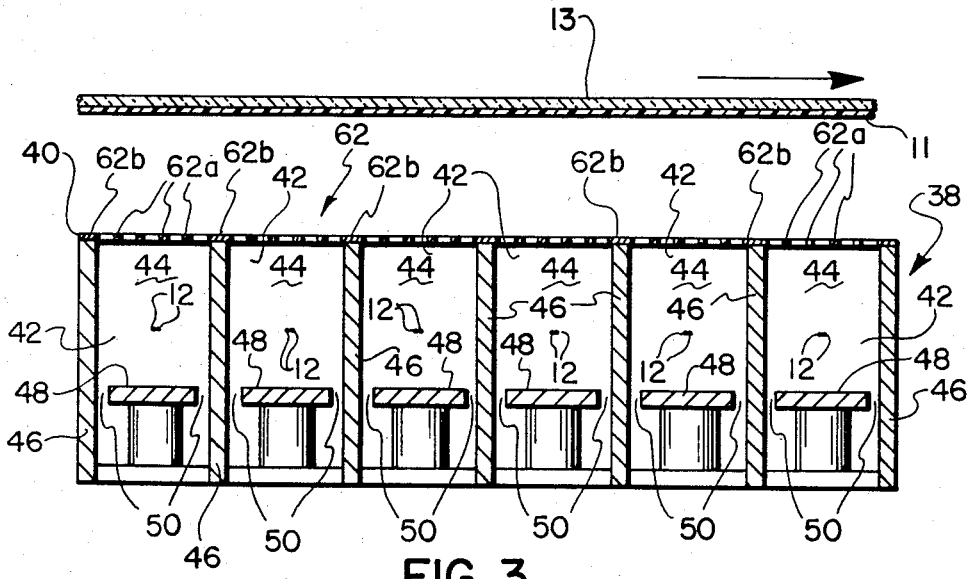
FIG. 3 is a section view along lines 3—3.
Figure 4:
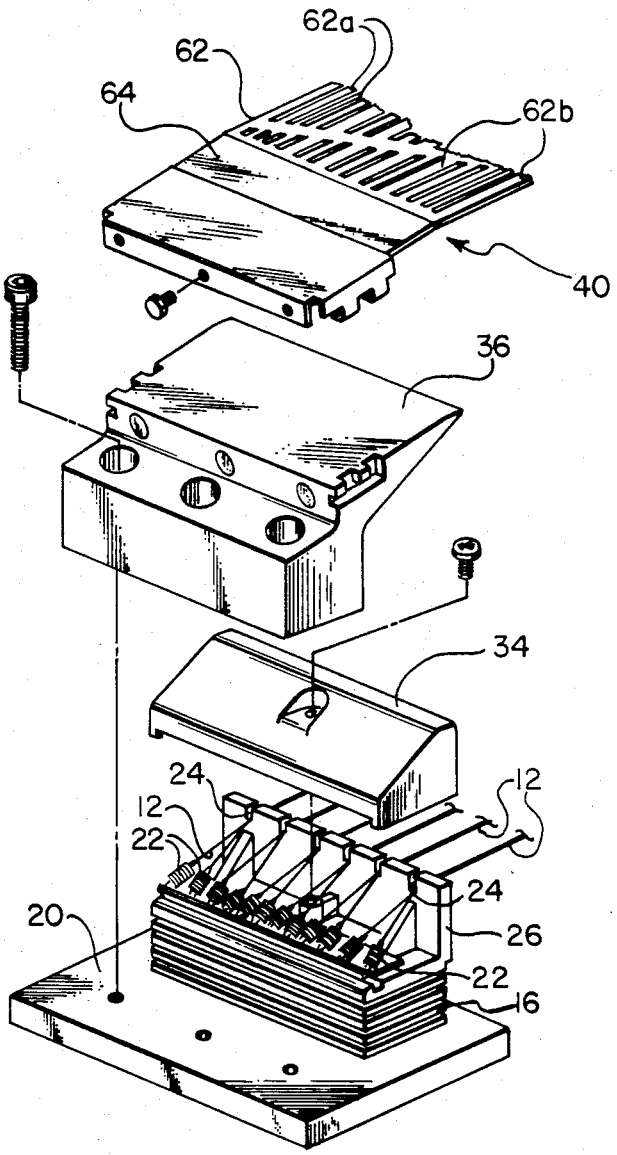
FIG. 4 is an enlarged perspective view of the spring loaded grid end block shown in FIG. 1.
Figure 5:
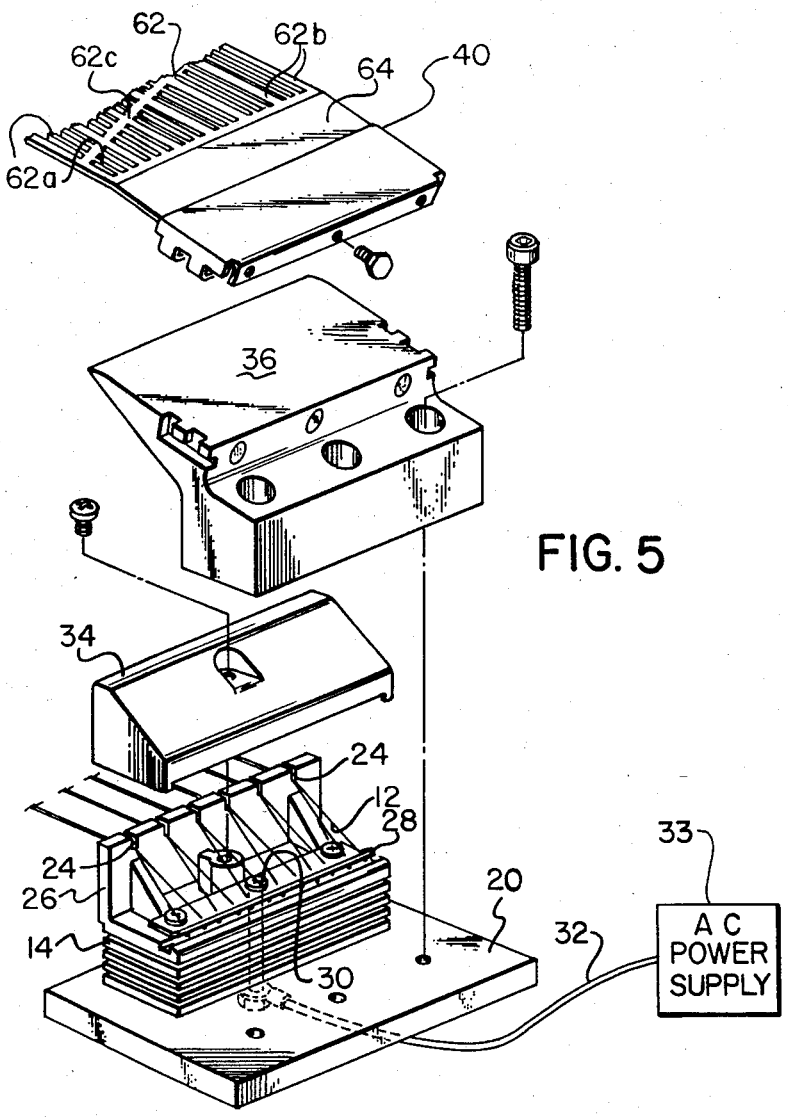
FIG. 5 is an enlarged perspective view of the fixed grid end block shown in FIG. 1.

The corona generating apparatus is based on a coaxial electrode configuration wherein the corona wires or electrodes 12 (best shown in FIGS. 2 and 3) are made of thin tungsten wire generally less than 0.01 inches in diameter, the longitudinal axes of which are substantially parallel to one another. Tungsten was preferred for its resistance to corrosion and low propensity for beading.

The corona wires 12 extend in physically engaged, parallel pairs which are parallel to the longitudinal axis 18 of the corona generator apparatus. The pairs of corona wires 12 are tensioned between first and second wire support end blocks 14 and 16, respectively; one located at each end of the corona generating apparatus 10 with each of the wire support end blocks 14 and 16 being centered on the longitudinal axis 18 of the charger 10. Each of the wire support end blocks 14 and 16 is mounted to an insulator mounting plate 20. One end of each of the corona wires 12 is attached to the second wire support end block 16 by springs 22, which maintains tension on each wire 12 of 1–1.5 lb. Each wire support end block 14 and 16 has notches 24 along an upright portion or standoff 26 intended to support and align each engaged parallel pair of wires 12 with a corresponding notch 24 on the opposing wire upright standoff 26 on the first wire support block 14. It should be noted that each notch 24 in the upright standoff 26 holds two corona wires 12 in physical engagement. After the wires have passed through their respective notches 24 in the first wire support end block 14, they are securely attached to a bus bar 28. Corona wires 12 and bus bar 28 are connected via a machine screw 30 which extends through the wire support end block 14 and the plastic mounting plate 20, to a source of AC voltage. One end of cable 32 is connected to machine screw 30 while the other end is connected to an AC power supply 33.

Each of the wire support end blocks 14 and 16 receives a cover 34 which suppresses the formation of corona near the wire ends, and thus minimizes the corrosive effects associated therewith, within the confines of cover 34. Adjacent each end block 14 and 16 and their respective covers 34 and partially overlying thereon, is a grid support member 36.

Each engaged pair of corona wires 12 in this multiple wire configuration is surrounded on three sides by a conductive shell assembly 38 and on the fourth side by a grid 40 (to be described later). Shell assembly 38 is intermediate the end blocks 14 and 16, and is fabricated out of stainless steel because of its ability to resist the corrosive effects of the corona environment. Shell assembly 38 is comprised of a plurality of channels 42 which are coaxial with the corona wires and surround each pair of wires 12 on three sides thereof, to form a corona cavity 44. Two sides of each channel 42 are formed by vertical partitions 46 located on opposite sides of each pair of wires 12, with each of the pairs of wires 12 being approximately 1 cm from each of the adjacent partitions 46. The third side of the corona cavity formed within the channel 42 of shell assembly 38 is an air flow divider 48 intermediate partitions 46, and slightly spaced therefrom so as to form a slot 50 on either side of flow divider 48 and extending the length of channel 42.

Each end of the shell assembly 38 is attached to and supported by an insulator block 52, made of a molded epoxy material, this material being selected for its high bulk resistivity, high surface resistivity and hydrophobic properties. Each insulator block 52 is adjacent to the plastic mounting plate 20 which supports respective ones of the wire support blocks 14 and 16 at each end of the corona generating apparatus 10. Each insulator block 52 and the adjacent insulator mounting plate 20 are securely attached to a solid aluminum support plate 54. Each support plate 54 at the end of the corona generating apparatus 10 is in turn loosely attached via springs (not shown) to a nickel plated steel frame 56 that supports the entire corona generating apparatus 10. Located between each support plate 54 and attached thereto is an exhaust funnel 58 molded out of a plastic material. A duct 60 at the lower end of exhaust funnel 58 passes through frame 56 and is connected to an appropriate blower (not shown). The blower causes a flow of exhaust air, through shell assembly 38 via slots 50 to remove ozone and oxides of nitrogen from the corona cavity 44.

The grid 40 is fabricated from a thin rectangular sheet of stainless steel, and each end of the grid is attached to a respective grid support member 36 which properly aligns the grid 40 with respect to the shell assembly 38 and maintains a slight tension thereon. The mid-portion of the sheet that overlies the shell assembly 38 has been acid etched using a photoresist to form a series of parallel strips shown generally at 62 that extend the length of the shell assembly 38 with narrower strips 62*a* over the channels 42 and slightly wider strips 62*b* over the partitions 46. During the etching process, some thin sections of metal 62*c* are retained between adjacent strips 62 to provide additional supports to the strips 62 and thereby provide some rigidity to the grid structure, which minimizes sagging.

Both the shell assembly 38 and the grid 40 are maintained at the same DC potential by cable 66 which connects both the shell assembly 38 and the grid 40 to a DC power supply 41. This common DC potential permits the grid 40 to be precisely located against the shell assembly 38 with partitions 46 of the shell 38 being in contact with the wide strips **62*b* of the grid 40, thereby locating the grid at the correct distance from the corona wires 12 while also maintaining the flatness required of the grid 40. The flatness of the grid 40 is important because the resultant potential of the photoconductor 11 is a function of the distance between the photoconductor 11 and the grid 40. Therefore, it can be seen that the uniformity of the spacing between the grid and the photoconductor directly affects the voltage uniformity on the photoconductor. It is the presence of a conductive shell 38 that results in lowering the impedance of cavity 44 such that a relatively low voltage at the corona wire 12 will produce an electric field strength that exceeds the breakdown of air in the vicinity of the corona wires 12**.

The grid 40 acts much as the "grid" in a vacuum tube which regulates the flow of electrons from the cathode to anode. In this instance, the grid regulates the flow of ions between the corona generator and the photoconductor 11. Because both the grid and the shell are biased at the intended film potential, they tend to attract unwanted opposite polarity ions, and accelerate the preferred ion toward the photoconductor. The grid 40 defines an equipotential plane that is parallel to the surface of the photoconductor. The uncharged photoconductor with a zero charge attracts ions until its surface potential equals that of the grid. Once this equilibrium condition is reached, charging is complete.

Recent studies indicate that the principle forces involved in corona wire vibration are not electrostatic in nature, as many believed in the past, including U.S. Pat. No. 3,656,021 to Furuichi et al. It is now believed that the primary cause of wire vibration is a result of the repulsive force between the space charge cloud surrounding the wire and the restoring force of the spring 22 on the taut corona wire.

Although the geometrics and electrostatics associated with corona wire vibrations are very complex, the article by T. G. Davis, Xerox Corporation, Rochester, NY 14644, entitled "A Mechanism for Corona Wire Vibrations", *IEEE Conference Record, IAS Society,* 1977; 24E; pgs. 587–589, incorporated herein by reference, helps one to develop an understanding of the phenomenon at work.

It has been experimentally demonstrated that corona wire vibrations are highly correlated to corona current; see M. Frazany, L. Phan *IEEE Transactions on Power Apparatus and Systems,* Vol. PAS-103, No. 9, September, 1984 and L. Phan, T. Adachi, M. Allaire, *IEEE Transactions on Power Apparatus and Systems,* Vol. PAS-100, No. 4, April, 1981. Accordingly, no wire vibrations occur in the absence of a corona current. Davis concludes, in an analysis based on wire resonance, that the driving force for wire vibrations is the repulsive force between the wire and the surrounding space charge cloud. The dominant force in the system is the force between the wire and the space charge, far exceeding wire to shield forces, for example. A positive feedback phase relationship exists between the space charge cloud and the wire. As the corona wire is instantaneously displaced the electrostatic forces acting on the wire are such as to push it further in that direction. This continues until the wire reaches a pseudo equilibrium position with the mechanical and the electrostatic forces just balancing one another. However, the space-charge quickly re-establishes itself symmetrically around the displaced wire. With the space-charge being symmetrical about the wire, the electrostatic forces on the wire fall to zero. The mechanical restoring force, now unbalanced, draws the wire back toward the center. Inertia causes the wire to overshoot, thus repeating the cycle.

It appears that the wire vibrations are suppressed in Furuichi et al by selectively reducing ionization in certain regions. The strategic placement of insulators suppresses ionization and the corresponding space charge modifying the distribution of the space charge. However, the fact that ionization and space charge are distributed in a different pattern suggests that certain modes of vibration are still possible. The inclusion of insulators within the cavity probably reduces the problem of wire vibrations to some degree, but does not eliminate all modes of vibration. Another problem associated with the use of insulators is that the number and location within the cavity cannot easily be predicted and must be determined empirically.

In the present invention, the location of the space charge, and not the amount is modified. The action of the two equally biased and separated wires is to exclude the space charge from the region between the wires as this is a zero-field region. This eliminates the unstable equilibrium condition associated with the peak of the space charge distributions being centered at the wire, to an inherently stable situation with the wires located in a space-charge-free region. Unlike the use of insulators in the corona cavity which only suppress specific modes of wire vibrations, this invention displaces the space charge which is the actual source of the vibrations.

Figure 7:
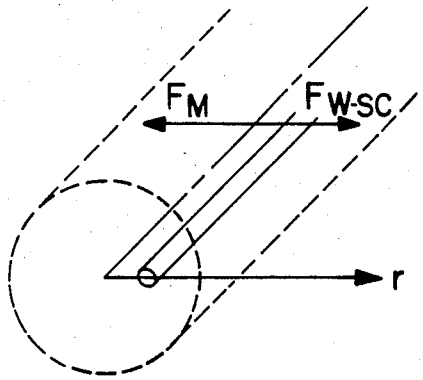
FIG. 7 is a graphical representation showing the forces involved in the geometry of a single wire.
Figure 8:
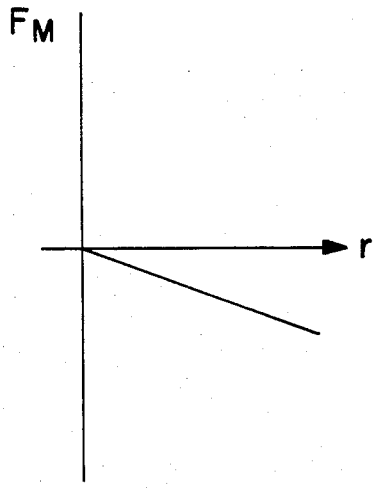
FIG. 8 is a graph showing mechanical restoring force versus distance.

The single-wire unmodified charger will be analyzed to illustrate how wire vibrations occur. With reference to FIG. 7 which illustrates the geometry involved with a single wire, two forces must be considered; the electrostatic force between the corona wire and the space charge cloud and the mechanical restoring force $F_M$ associated with wire tension. The mechanical restoring force $F_M$ associated with the wire tension as illustrated in FIG. 8, can be represented by:

$$F_M=(8Tr/L^2)$$

where T represents wire tension and L represents the length of the wire. The displacement of the wire is given by r.

The electrostatic forces on the wire can be represented by:

$$F_{sc}=\lambda_w E_{sc}$$

where the charge density on the wire is given by $\lambda_w$ and $E_{sc}$ is the field associated with the space charge distribution.

T. G. Davis states on page 587 of the above-referenced article: "Observations of dc corona wires which exhibit sustained vibrations show a significant difference between the oscillation frequency and the resonant frequency of the wire in the absence of corona. The observed system instabilities are shown to be consistent with a mechanism in which the required force and phase shift are due to modulation of the energy stored in the ion space charge distribution, and the space charge relaxation time."

Figure 6:
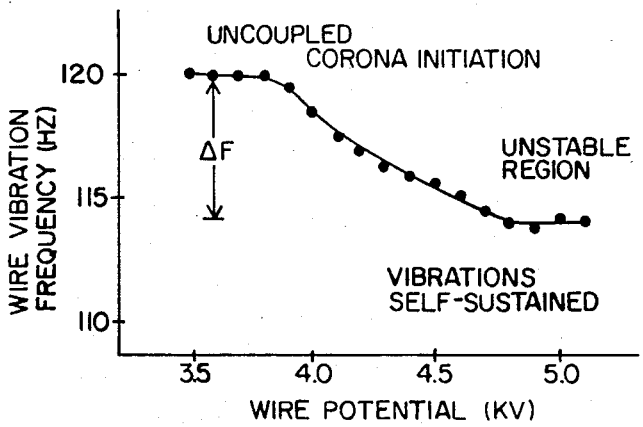
FIG. 6 is a graph showing wire vibration frequency versus wire potential.

FIG. 6 taken from the Davis article illustrates the typical dependance of resonant frequency upon wire potential. Before the corona turns on, one would expect a small negative slope to the curve, due to the electrostatic forces. As may be seen in the graph, the effect is very small. However, above the point at which the corona turns on, there is a dramatic decrease in wire frequency. At some value of current, the system becomes unstable and the oscillations are self-sustained. Further increases in wire potential do not change the resonant frequency of the system. Plausible mechanisms for system instability would be (1) modulation of the corona wind; and (2) modulation of the energy stored in the ion space charge as the wire vibrates. In the first instance, in the case of corona wind, the velocities are too low and therefore, this must be eliminated as a possible explanation. The instability would result from the instantaneous displacement of the corona wire. A step displacement of the corona wire would generate a component of force which relaxes as the space charge reestablishes itself. Although the process is probably highly non-linear, it would be greatly variant with time.

Figure 9:
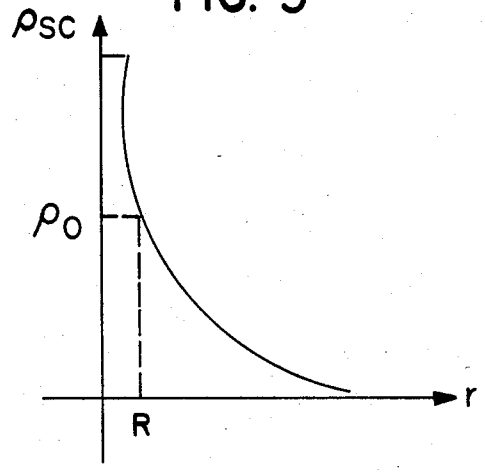
FIG. 9 is a graph showing space charge density versus distance.

Assuming that the space charge density follows the 1/r relationship shown in FIG. 9 which is a graph of space charge density vs. distance. The equation takes the form:

$$\rho sc=\rho_o(R/r)$$

where R is the corona wire radius and r is the actual distance from the wire center.

Applying Gauss' Law to the region around the wire results in:

$$E_{sc}=\rho_o{}^R/\epsilon_o$$

where $\epsilon_0$ is the permittivity of free space.

The electrostatic force between wire and space charge is:

$$F_{sc}=\lambda_w\rho_o{}^R/\epsilon_o$$

Figure 10:
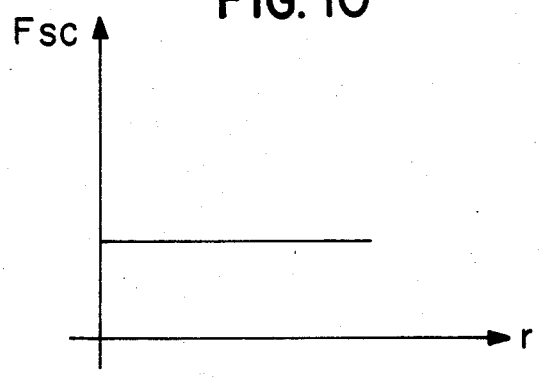
FIG. 10 is a graph showing force on the wire due to space charge versus distance.

FIG. 10 illustrates the force on the wire due to the space charge.

Combining the forces between wire and space charge with the mechanical restoring force on the wire:

$$F_{tot}=(\lambda_w\rho_o{}^R/\epsilon_o)-(8Tr/L^2)$$

Figure 11:
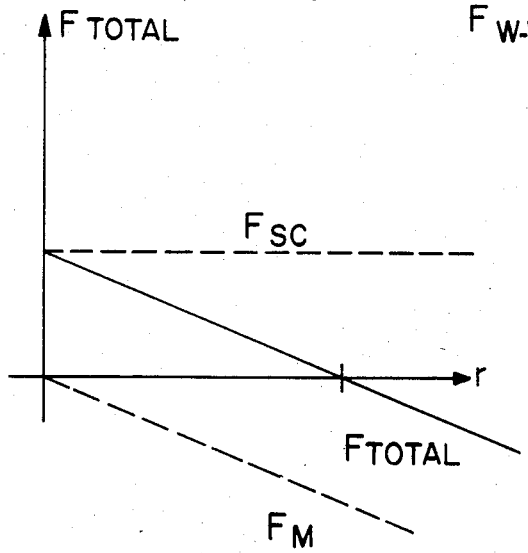
FIG. 11 is a force diagram for a single wire geometry.

FIG. 11 illustrates a force diagram for a single wire system. The total force would be the resultant force of the space charge $F_{sc}$ and the mechanical restoring force $F_M$. Once again, this is an unstable condition, and varies over time in proportion to the relaxation time of the space charge cloud. The point at which $F_{tot}$ intersects the r axis represents the peak amplitude of oscillation of the wire.

Figure 12:
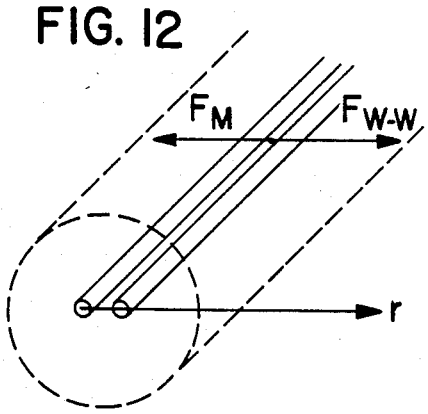
FIG. 12 is a graphical representation showing the force involved in the geometry of a dual wire system.

The dual wire geometry in FIG. 12 illustrates that the wires are repulsed by their mutual fields and not by the space charge which surrounds the wires. Since there is no space charge in the zero field region between the wires, each wire "sees" an equal and symmetric external space charge distribution. Thus, the wire-to-space charge force is zero.

The wire-to-wire forces are not present with the single wire charger. With the application of bias to the corona wires, the wires are separated and reach a stable equilibrium resulting from the balance between the mechanical restoring forces and the electrostatic wire-to-wire forces $F_{w-w}$. This is very different than the single wire case in that the wire-to-wire forces $F_{w-w}$ unlike the wire-to-space charge forces $F_{w-sc}$ are stable with time and space. Thus, the positive feedback mechanism in this instance is eliminated. Similarly, as with the single wire case, the mechanical forces for the dual wire are given by:

$$F_M=(8Tr/L^2)$$

The electrostatic wire-to-wire forces $F_{w-w}$ can be evaluated from $F_{w-w}=\lambda_w\times E_w$ where $E_w$ is interpreted as the field from the other wire. By applying Gauss' Law to the region around the wire:

$$E_W=\lambda_w/2\pi\epsilon_o r$$

Where $\epsilon_0$ in the above equation represents the permittivity of free space, and from above:

$$F_{w-w}=\lambda^2{}_w/2\pi\epsilon_o r$$

Figure 14:
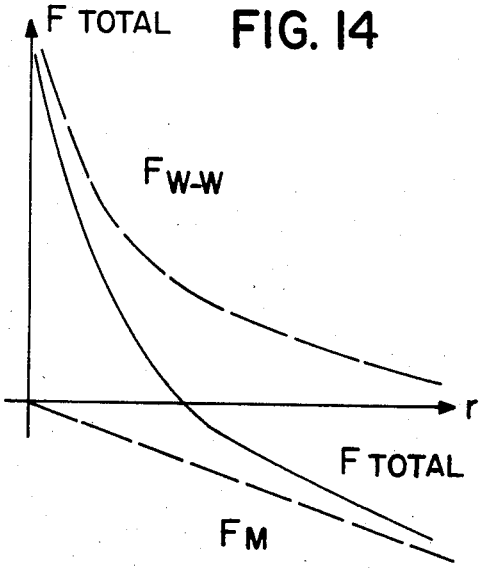
FIG. 14 is a force diagram for a dual wire system.

Thus, the total force which is illustrated in FIG. 14 is given as:

$$F_{tot}=\lambda^2{}_w/2\pi\epsilon_o r$$

Figure 13:
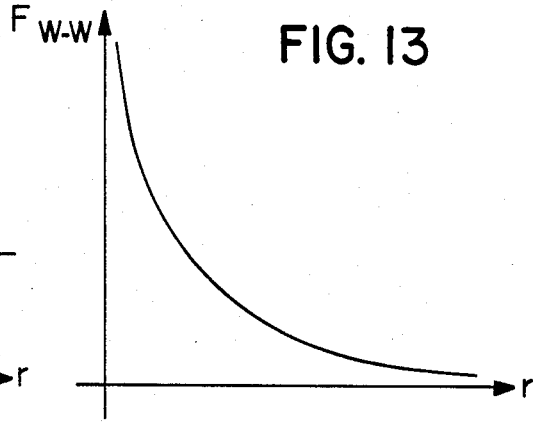
FIG. 13 is a graph showing wire to wire force versus distance.

The graphical representation of $F_{w-w}$ is illustrated in FIG. 13.

The space charge cannot exist in the plane between the two wires. As a result of this, the stability of the dual wire system should be relatively insensitive to the initial wire-to-wire spacing because the electrostatic forces will establish the spacing upon application of bias. However, as the wire-to-wire spacing gets larger and larger, eventually the space charge will encroach into this region and will then again result in instability of the wires. Therefore, for the greatest effect in corona wire vibration suppression, the wires should be placed as close as possible to one another, and for greatest effect, should be in physical contact along their line length before any bias voltage has been applied to them. Thus, in this situation, the maximum separation of the wires will be the result of the electrostatic repulsive forces between the wires.

While the invention has been described in conjunction with specific embodiments thereof, it is evident that many alternatives and variations will be apparent to those skilled in the art, in light of the foregoing description. For example, even though wire pairs were described in the preferred embodiment, there is no reason a plurality of wires could not be used. Accordingly, it is intended to embrace all such alternatives, modifications and variations as fall within the spirit and scope of the appended claims.

What is claimed is:

1. Apparatus for use in imparting charge to a photoconductive member including:

an elongated shield, the improvement comprising at least two parallel, electrically biasable coronode wires supported at their ends by wire support members, said coronode wires extending in physical contact with each other longitudinally along the length of said shield prior to the biasing of said coronode wires and remaining in physical contact only adjacent the support members after biasing.

2. The apparatus as recited in claim 1 additionally comprises a scorotron grid between the coronode wires and the photoconductive member.

3. The apparatus recited in claim 1 wherein said coronode wires are separated by less than 1.5 mm intermediate said wire support members subsequent to the application of bias to said coronode wires.

4. A corona generating device comprising at least a pair of coronode wires supported between end block assemblies, said wires being in physical contact with each other intermediate the end block assemblies, means for applying a bias voltage to said coronode wire, upon application of said bias voltage, the coronode wires intermediate said end block assemblies being forced apart by the electrostatic field surrounding each of said coronode wires.

5. The corona generating device of claim 4 including a wire support member at each end block assembly, said wire support members having a wire aligning notch therein through which both wires pass, with each wire being urged into contact with the other within the notch.

6. In a corona generating apparatus having lengths of tensioned coronode wire mounted in parallel for producing a corona along said lengths when said wires are electrically biased with a corona generating potential, the improvement comprising:

means effective when said wires are in a non-biased condition for supporting the same in physical contact throughout said lengths and effective when wires are in a biased condition for supporting in physical contact only the portions of said wires adjacent to the extremities of said lengths.

* * * * *